United States Patent [19]

Kinnebrew, II et al.

[11] Patent Number: 4,946,510

[45] Date of Patent: Aug. 7, 1990

[54] GOLF CLUB GRIP CLEANER

[75] Inventors: Earl G. Kinnebrew, II, Edmond; Joseph D. Fitzpatrick, Blanchard, both of Okla.

[73] Assignee: Master's International Corporation, Edmond, Okla.

[21] Appl. No.: 228,708

[22] Filed: Aug. 4, 1988

[51] Int. Cl.[5] ..... B08B 1/00

[52] U.S. Cl. ..... 134/40

[58] Field of Search ..... 134/40; 252/135, 158

[56] References Cited

U.S. PATENT DOCUMENTS 3,558,495 1/1971 Mace ..... 252/135
4,554,696 11/1985 Nye ..... 15/21 D
4,676,839 6/1987 Osborn ..... 15/21 R
4,750,230 6/1988 Osborn ..... 15/21 D
4,767,563 8/1988 de Buzzaccarini ..... 252/174.5

*Primary Examiner*—Asok Pal
*Assistant Examiner*—Ourmazd S. Ojan
*Attorney, Agent, or Firm*—Head & Johnson

[57] ABSTRACT

A rubber golf club grip cleaner for applying a cleaning mixture to a golf club grip having a container for containing a quantity of the cleaning mixture and means for engaging the grip to clean the grip with the cleaning mixture thereon. The cleaning mixture comprises a grease cutting agent and a tackiness agent for cleaning grease or oils from the grip and maintaining the tackiness of the grip.

10 Claims, 4 Drawing Sheets

GOLF CLUB GRIP CLEANER

FIELD OF THE INVENTION

The present invention relates generally to golf club grip cleaners and cleaning mixtures for cleaning golf club grips.

DESCRIPTION OF THE PREFERRED EMBODIMENTS

Rubber grips of golf clubs commonly get dirty and greasy with use. In the past, it has been difficult to clean these grips because cleaning with water and soaps tended to remove the tackiness of the grip. Thus, it has not been common to clean the grips of gold clubs in the past.

The present invention provides a quick, convenient and economical means for cleaning the grips of golf clubs while still retaining and/or restoring the tackiness of the grip.

Figure 1:
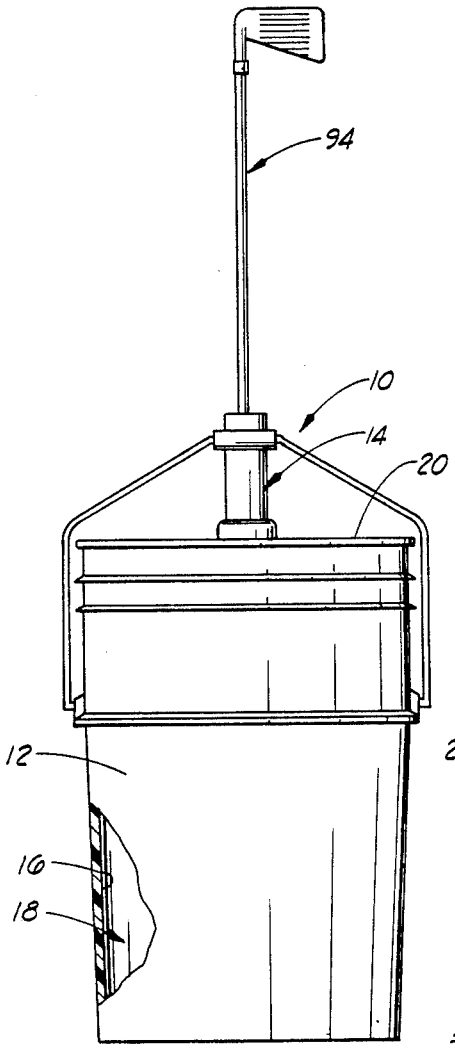
FIG. 1 is a side elevational view of a golf club grip cleaner constructed in accordance with the present invention and having the grip .of a golf club partially inserted therein.

Shown in FIG. 1 and designated therein by the general reference numeral 10 is a golf club grip cleaner constructed in accordance with the present invention. The golf club grip cleaner includes a container 12 and a cleaning assembly 14. The container 12 includes an opening 16 which extends therethrough and intersects an upper end thereof. The opening 16 provides a space 18 within the container 12 and the space 18 is adapted to retain a quantity of cleaning mixture.

A lid 20 is placed over the open upper end of the container 12 thereby enclosing the space 18 within the container 12. An opening 22 is formed through a central portion of the lid 20 and the cleaning assembly 14 is disposed through the opening 22 in the lid 20 with a portion of the cleaning assembly 14 extending a distance generally above the lid 20 and another portion of the cleaning assembly 14 extending a distance generally into the space 18 within the container 12. The lid 20 forms the upper end of the container 12.

Figure 2:
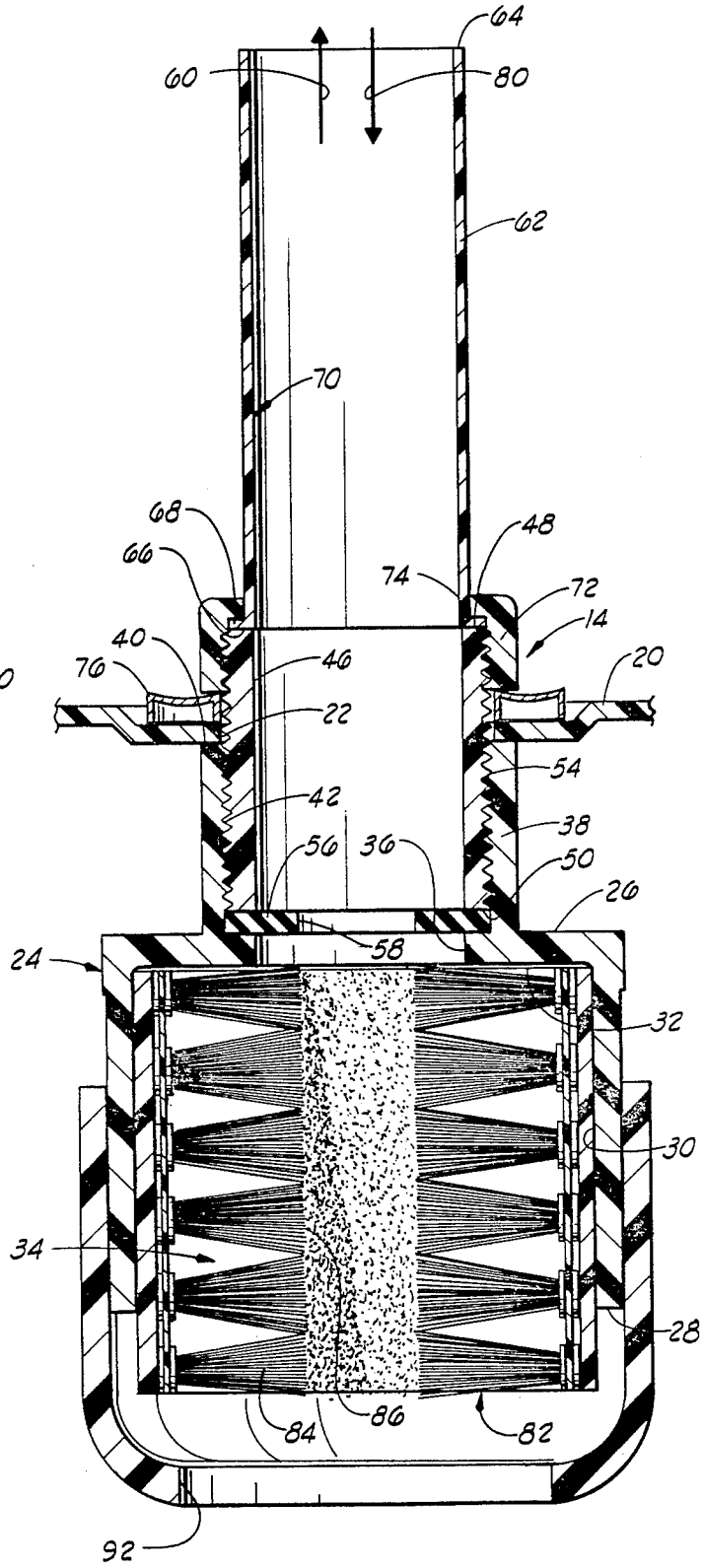
FIG. 2 is a sectional view of the cleaning assembly of the golf club grip cleaner shown in FIG. 1.

The cleaning assembly 14, as shown more clearly in FIG. 2, includes a cylindrically shaped base 24 having an upper end 26 and a lower end 28. An opening 30 is formed through the lower end 28 of the base 24 and the opening 30 extends a distance through the base 24 terminating with an upper wall 32. The opening 30 forms a generally cylindrically shaped space 34 within the base 24. An opening 36 is formed through the upper end 26 of the base 24 and the opening is in communication with the space 34. The opening 36 is sized to receive a golf club grip.

A tubular extension 38 is formed on or connected to the upper end 26 of the base 24 and the tubular extension 38 is generally cylindrically shaped. The tubular extension 38 extends a distance upwardly from the upper end 26 of the base 24 terminating with an upper end 40. The tubular extension 38 has an opening which extends therethrough and intersects the opposite ends thereof and the opening 42 is threaded. The tubular extension 38 is generally cylindrically shaped.

A cylindrically shaped tube 46 is disposed in the opening 42 in the tubular extension 38. The tube 46 has an upper end 48 and a lower end 50. An opening 52 is formed through the tube 46 intersecting the upper end 48 and the lower end 50 thereof. An outer peripheral surface 54 of the tube 46 is threaded The tube 46 is threaded into the threaded opening 42 of the tubular extension 38 to a position therein so that the upper end 48 of the tube 46 extends a distance above the upper end 40 of the tubular extension 38.

Cylindrically shaped ring 56 constructed of a resilient material such as rubber is disposed in the opening 42 in the tubular extension 38. The ring 56 is disposed generally near the lower end of the tubular extension 38 and generally near the upper end 26 of the base 24. In an assembled position, the lower end 50 of the tube 46 engages the ring 56 and the ring 56 is held in an assembled position by the tube 46 and an upper end portion of the base 24. The ring 56 has an opening 58 which extends through a central portion thereof and the opening 58 is sized to be slightly smaller than the diameter of a typical golf club grip so that the ring 56 engages the golf club grip as the golf club grip is being moved in a generally upwardly direction 60 for removing excess water and cleaning mixture from the golf club grip as the golf club grip is removed from the cleaning assembly 14.

The cleaning assembly 14 also includes an entry tube 62 having an upper end 64 and a lower end 66, a flange 68 is formed on the lower end 66 of the entry tube 62 and the flange 68 extends a distance generally outwardly from the outer peripheral surface of the entry tube 62. The flange 68 is disposed generally on the upper end of the tube 46. An opening 70 is formed through the entry tube 62 and the opening 70 extends through the entry tube 62 intersecting the upper and the lower ends 64 and 66 thereof.

A cap 72 is threaded on the upper end 48 portion of the tube 46. The cap 72 includes a flange 74 and the flange 74 engages the flange 68 of the entry tube 62, the cap 72 cooperating to secure the entry tube 72 in an assembled position on the upper end 48 of the tube 46. The lower end of the cap 72 engages a retaining ring 76 disposed on the upper surface of thye lide 20 so that the upper end 48 of the tube 46 engages the lower surface of the lid 20 generally adjacent the opening 22 and the cap 72 engages the upper surface of the lid 20 generally near the opening 22 for securing the cleaning assembly in an assembled position secured to the lid 20.

In the assembled position of the cleaning assembly 14, the openings 70, 46 and 36 cooperate to form a grip opening 78 which extends through the cleaning assembly 14 intersecting the upper end and the lower end thereof with the grip opening 78 being sized to receive the grip of a golf club which can be pushed in a downwardly direction 80 generally through the grip opening 78.

A brush assembly 84 is removably disposed generally within the opening 30 in the base 24. The brush assembly 82 includes a plurality of brushes which extend into the space 34 and form a cylindrically shaped brush opening 86 having a diameter less than the diameter of a golf club grip. The brush opening 86 is a part of the grip opening 78.

Figure 3:
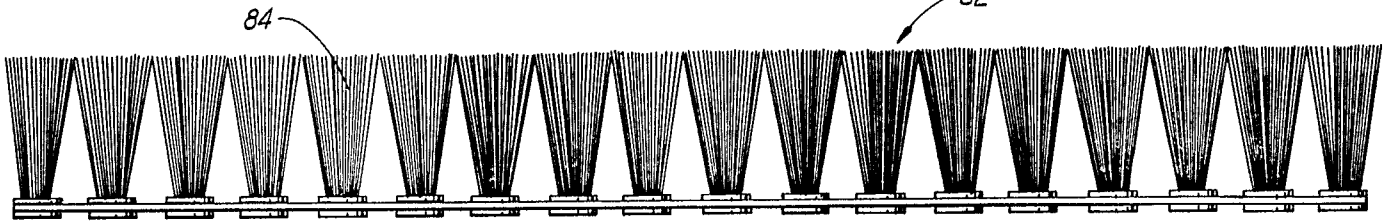
FIG. 3 is an enlarged top elevational view of the brush assembly used in the cleaning assembly shown in FIG. 2.
Figure 4:
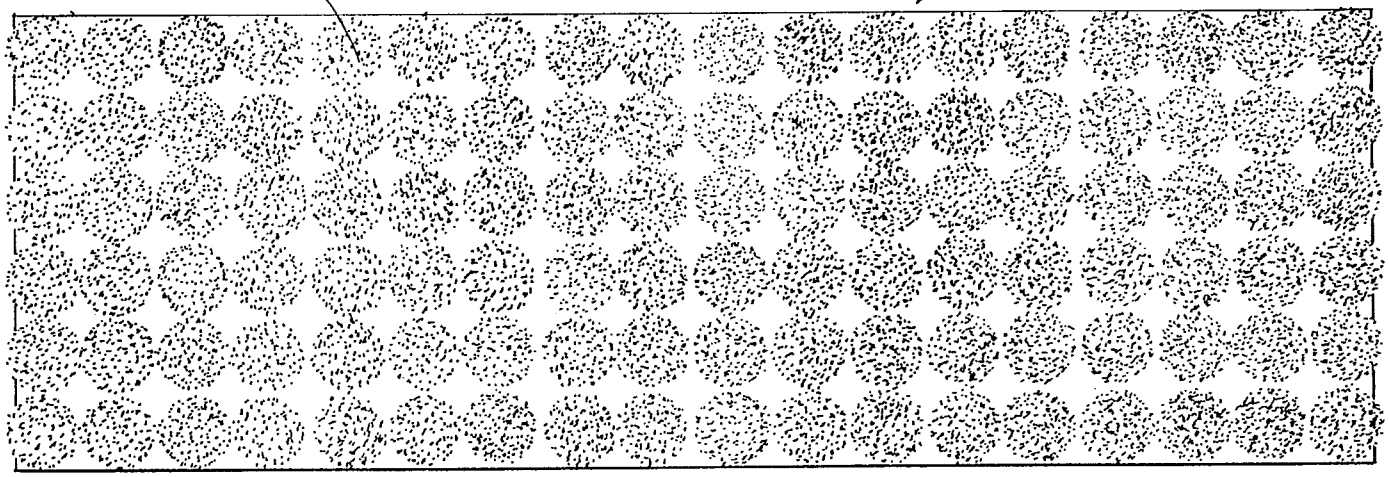
FIG. 4 is a side elevational view of the brush assembly of FIG. 3.

As shown more clearly in FIGS. 3 and 4, the brush assembly 82 includes a brush base 88. One end of each of the brushes 84 is connected to the brush base 88 and each of the brushes extends a distance generally outwardly from the brush base 88. In an assembled position, the brush base 88 is rolled in the general form of a cylinder and the rolled brush base 88 is inserted in the upward direction 60 upwardly into the opening 30 in the base 24. When the brush base 88 is released, the cylindrical shape of the brush base 88 is retained by the base 24 and the forces tending to straighten the brush base 88 into a flatten position as illustrated in FIGS. 3 and 4 tend to secure the brush base 88 with the brushes 84 connected thereto in an assembled position within the opening 30 in the base 24.

A lower cap 90 is secured over the lower ends 28 of the base 24. An opening 92 is formed through the lower cap 90. The opening 92 is aligned generally with the opening 30 and the base 24 and with the brush opening 86. The brush opening 86 and the opening 92 also cooperate to form the grip opening 78.

In operation, the space 18 within the container 12 is filled with the cleaning mixture. An individual inserts the grip of a golf club such as the golf club 94 into the grip opening 78. The individual then moves the golf club 94 in the downward direction 80 through the grip opening 78 and into the cleaning mixture. The individual then reciprocates the golf club alternately in the upward direction 60 and the downward direction 80 generally within the brush opening 86 and the action of the brushes 84 together with the cleaning mixture cooperate to clean the golf club grip. After cleaning, the individual pulls the golf club 94 in the upward direction 60 so that the golf club grip moves through the ring 56, the ring 56 engaging the golf club grip and wiping excess cleaning mixture and water from the golf club grip as the individual continues to move the golf club in the upward direction 60 to remove the golf club with the cleaned golf club grip from the golf club grip cleaner.

As mentioned before, normal cleaning agents such as soaps cannot be used effectively to clean golf club grips because they tend to remove the tackiness and leave the golf club grip slick which is very undesirable. It has been found that a particular cleaning mixture described below functions to clean the grease and dirt from the golf club grip while retaining the tackiness of of golf club grip.

The cleaning mixture of the present invention comprises the following components in a thirty gallon bath.

1. (1.25% by weight) 3 lb. anhydrous sodium metasilicate (silicic acid and disodium) commercially available from such sources as Diamond Shamrock Chemicals Company of Irving, Tex., S-25;

2. (0.80% by weight) 2 lb. sodium tripolyphosphate, commercially available from such sources as Ashland Chemical Company of Columbus, Ohio, Product No. 3928041;
3. (10.25% by weight) 3½ lb. solvent, ethylene glycol monobutyl ether commercially available from such sources as Eastman Kodak Company, Ektasolve® EB solvent;
4. (2.0% by weight) 35 ounces sodium xylene sulfate 40% commercially available from such sources as Ashland Chemical Company, Columbus, Ohio;
5. (0.20% by weight) ½ lb. caustic soda beads commercially available from such sources as Occidental Chemical, M4820;
6. (7.0% by weight) 2½ gallons, surfactant, such as a nonionic surfactant commercially available from such sources as Thompson-Hayward Chemical, Kansas City, Kans., T DET N 9.5; and
7. The balance of the 30 gallons being water.

Anhydrous sodium metasilicate is a base used in cleaning formulations which aids in cleaning oils and grease from the golf club grip. The sodium tripolyphosphate is a deflocculating agent which aids in the dispersion of particles thereby improving the action of particles or solutes within the solution or suspension. The solvent, preferably ethylene glycol monobutyl ether, holds the surfactant in solution and improves the emulsifying properties of the solution. The solvent also leaves a film on the golf club grip which is sticky or "tacky" to the touch. The sodium xylene sulfonate is a hydrotropic solvent which increases the aqueous solubility of various slightly soluble organic chemicals. The surfactant reduces the surface tension between two liquids such as oil and water thereby producing a wetting, emulsifying or detergent effect.

The cleaning mixture comprises a grease cutting agent and a tackiness agent for rendering the golf club grip tacky. The cleaning mixture will remove dirt and grease oroils and tar. The cleaning mixture acts to rejuvenate the rubber golf club grip.

Figure 5:
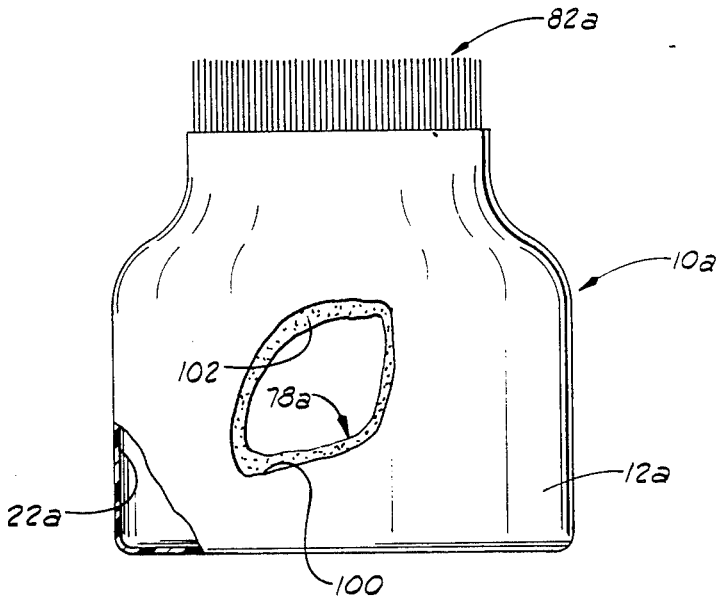
FIG. 5 is a side elevational view of a modified golf club grip cleaner.

Shown in FIG. 5 is a modified golf club grip cleaner **10*a* having a modified container 12*a* with an opening 22*a* for retaining a quantity of the cleaning mixture and a modified brush assembly 82*a*. The brush assembly 82*a* comprises a plurality of brushes affixed to the upper end of the container 12*a*. A circularly shaped opening 100 is formed through a central portion of the container 12*a***.

A pad 102 is connected to the container **12*a*. The pad 102 extends generally about the opening 100 and forms a modified grip opening 78*a*. The grip opening 78*a* has a diameter smaller than the diameter of the grip of a golf club. The pad 102 is in communication with the cleaning mixture and the pad 102 absorbs the cleaning mixture so the cleaning mixture is available through the pad 102**.

In operation, an individual pushes the grip of a golf club through the grip opening **78*a* so the pad 102 contacts the grip and applies the cleaning mixture to the grip. The individual then uses the brush assembly 82*a*** to brushingly clean the grip with the cleaning mixture thereon.

Figure 6:
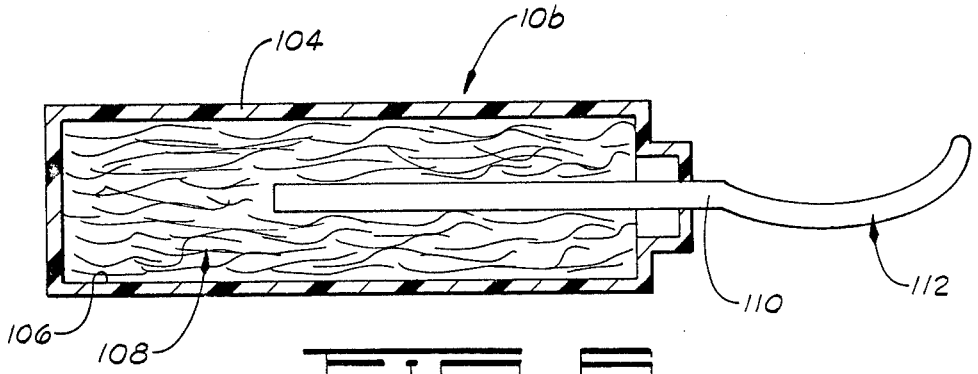
FIG. 6 is a side elevational view of another modified golf club grip cleaner.

Shown in FIG. 6, is another modified golf club grip cleaner **10*b* which includes a container 104 having an opening 106 extending through a portion thereof. A transorb 108 is disposed in the opening 106 and the transorb 108 is adapted to retain a quantity of cleaning mixture and to controllingly transfer a quantity of the cleaning mixture to a nib 110. One end of the nib extends through a portion of the transorb 108 and the opposite end of the nib 110 extends a distance beyond one end of the container 104 and is formed on a curve forming a curved portion 112**.

In operation, the individual holds the golf club and contacts the grip with the curved portion 112. The curved portion 112 of the nib 110 applys the cleaning mixture to the grip and functions to scrub the grip in a manner similar to the brush assemblies 78 and 78*a* described before. A cap may be included for covering the curved portion 112 of the nib 110 to reduce loss of cleaning mixture via evaporation.

Figure 7:
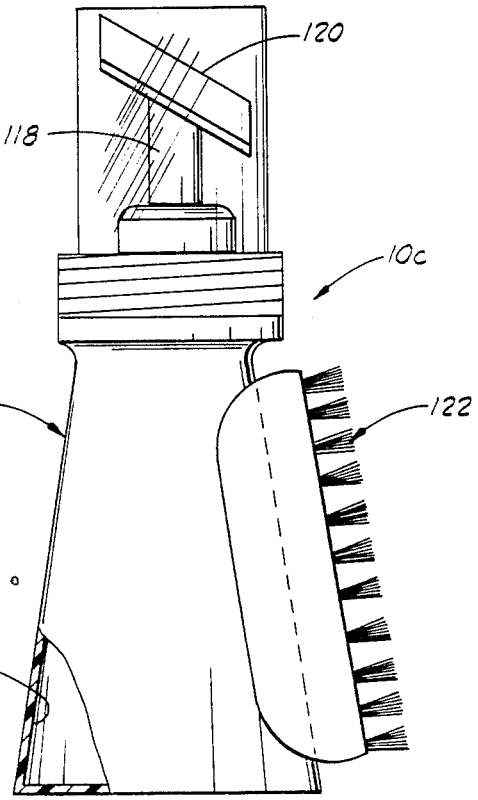
FIG. 7 is a side elevational view of yet another modified golf club grip cleaner.

Shown in FIG. 7 is another modified golf club grip cleaner 10*c*. The cleaner 10*c* includes a container 114 having an opening 116 which is sized and shaped for retaining a quantity of the cleaning mixture. One end of a tube 118 is connected to the upper end of the container 114 and the tube 118 has an opening (not shown) extending therethrough intersecting the opposite ends thereof. The opening in the tube 118 is in communication with the opening 116 in the container 114. A pad 120 is connected to one end of the tube 118 and the pad 120 is adapted to absorb and retain a quantity of the cleaning mixture. A brush assembly 122 is connected to the side of the container 114.

In operation, the individual inverts the container 114 so the cleaning mixture flows into the pad 120 via gravity. The individual applies the cleaning mixture to the grip by contacting the grip with the pad 120 and the grip is cleaned using the brush assembly 122.

Figure 8:
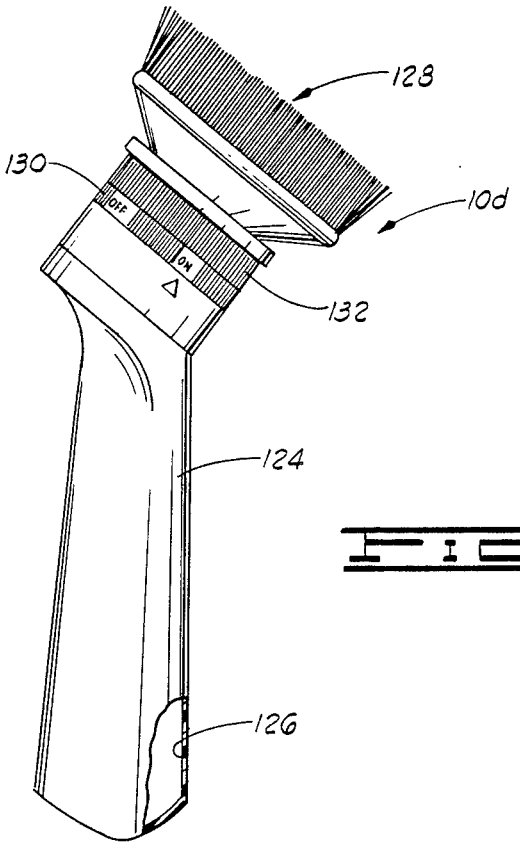
FIG. 8 is a side elevational view of still another modified golf club grip cleaner.

Shown in FIG. 8 is another modified golf club grip cleaner 10*d*. The cleaner 10*d* includes a container 124 having an opening 126 for retaining a quantity of the cleaning mixture. A brush assembly 128 is connected to the upper end of the container 124. A disc 130 is rotatably connected to the upper end of the container 124 and the disc 130 is interposed between the container opening 126 and the brush assembly 128. A disc 132 is interposed between the disc 130 an the brush assembly 128. The discs 130 and 132 include openings (not shown). In one position of the disc 130 ("off"), the openings in the discs 130 and 132 are not aligned and the brush assembly 128 is not in communication with the cleaning mixture in the container 124. In one other position ("on"), the openings in the discs 130 and 132 are aligned and the brush assembly 128 is in communication with the cleaning mixture in the container 124.

In operation, the individual turns the disc 130 to the "on" position so cleaning mixture flows out through the brush assembly 128. The brush assembly 128 is utilized by the individual for applying the cleaning mixture and brushingly cleaning the grip.

Changes may be made in the various parts, elements and assemblies and in the steps or in the sequence of steps of the methods described herein without departing from the spirit and the scope of the invention as defined in the following claims.

We claim:

1. A method for cleaning a rubber grip of golf club comprising:

applying a cleaning mixture to the grip, the cleaning mixture comprising a grease cutting agent and an agent for restoring tackiness to said grip, the grease cutting agent removing grease or oils from the grip and the tackiness agent operating to maintain the tackiness of the grip, and wiping any excess cleaning mixture from the grip.

2. The method of claim 1 wherein the tackiness agent is a solvent.

3. The method of claim 2 wherein the tackiness agent is ethylene glycol monobutyl ether.

4. The method of claim 1 wherein the grease cutting agent is a surfactant.

5. The method of claim 1 wherein the cleaning mixture is defined further to comprise anhydrous sodium metasilicate.

6. The method of claim 1 wherein the cleaning agent is defined further to comprise sodium xylene sulfonate.

7. The method of claim 1 wherein the cleaning mixture is defined further to comprise a deflocculating agent.

8. The method of claim 7 wherein the deflocculating agent is defined further as sodium tripolyphosphate.

9. The method of claim 11 wherein the cleaning mixture is defined further to comprise soda.

10. The method of claim 1 including the step of brushing said grip after applying said cleaning mixture.

* * * * *